US007225924B2

(12) United States Patent
Hanson et al.

(10) Patent No.: US 7,225,924 B2
(45) Date of Patent: Jun. 5, 2007

(54) FLAT MAIL SLEEVE PACKAGING AND METHOD OF USE

(75) Inventors: Bruce H. Hanson, Endicott, NY (US); J. Edward Roth, Lansdale, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 419 days.

(21) Appl. No.: 10/082,246

(22) Filed: Feb. 26, 2002

(65) Prior Publication Data

US 2003/0159960 A1 Aug. 28, 2003

(51) Int. Cl.
*B65D 85/62* (2006.01)

(52) U.S. Cl. ..... 206/451; 206/424

(58) Field of Classification Search ..... 206/215, 206/449, 451, 424, 194, 195, 821; 211/50; 53/399, 531, 540, 547
See application file for complete search history.

(56) References Cited

U.S. PATENT DOCUMENTS 1,286,374 A * 12/1918 McDonald ..... 206/449
1,296,765 A * 3/1919 Christensen ..... 229/87.03
1,381,904 A * 6/1921 Christensen ..... 229/87.01
1,467,357 A * 9/1923 Davies ..... 40/383
3,592,344 A * 7/1971 Schade ..... 211/42
3,783,579 A * 1/1974 Howe ..... 53/436
3,885,668 A * 5/1975 McClain ..... 312/240
4,003,611 A * 1/1977 Smith ..... 312/244
4,037,750 A * 7/1977 Box ..... 220/4.24
4,254,872 A * 3/1981 Garrett ..... 206/561
5,135,352 A 8/1992 Scata et al.
5,415,514 A * 5/1995 Butterfield ..... 414/403
5,452,985 A 9/1995 Roch et al.
5,549,202 A * 8/1996 Whiteside ..... 206/436
5,617,784 A 4/1997 St. John et al.
5,842,827 A 12/1998 Kwasniewski et al.
5,868,546 A 2/1999 Hahne et al.
5,951,238 A 9/1999 Duecker
D415,730 S * 10/1999 Jacobsmeyer ..... D12/416
6,102,651 A 8/2000 Hahne et al.
6,149,149 A 11/2000 Gämmerler et al.
6,305,566 B1 * 10/2001 Pigott et al. ..... 220/6
6,588,605 B1 * 7/2003 Volkert et al. ..... 211/41.14

* cited by examiner

*Primary Examiner*—Mickey Yu
*Assistant Examiner*—Jerrold Johnson
(74) *Attorney, Agent, or Firm*—Greenblum & Bernstein, P.L.C.

(57) ABSTRACT

A flat mail sleeve packaging system which is adapted to stack product in a constrained homogenous mass. The system includes a first constraining wall and a second constraining wall. The second constraining wall is positioned with respect to the first constraining wall at a substantially perpendicular angle thereto. The first and second constraining walls are adapted for having the product placed therebetween with bound edges of the product all facing in a same direction without collapsing. A third constraining wall may also be provided forming a "U" shape with the first and second constraining walls.

15 Claims, 3 Drawing Sheets

FLAT MAIL SLEEVE PACKAGING AND METHOD OF USE

BACKGROUND OF THE INVENTION

1. Field of the Invention

The present invention generally relates to a flat mail sleeve packaging system and method of use and, more particularly, to a flat mail packaging system used for packaging counter rotated bulk flats into a bundle.

2. Background Description

Publishers throughout the world print bulk flats (i.e., magazines, newspapers or other items typically less than 1¼ inch in thickness) which are delivered to the end consumer by a postal service or other delivery or transportation company. However, these products typically have bound edges and non-bound edges, where the bound edges are thicker than the non-bound edges. This difference in thickness may cause a "banana" effect or a tipping of the product when stacked at the publishing facilities.

To ensure that the "banana" effect or tipping does not occur, the publisher will either tightly wrap the bundle or, more commonly, assemble the stacks of their product in a counter rotated bundle, i.e., with the bound edges rotated every so many pieces in order to maintain a straight stack. In the former stacking process, the product is bound so tightly with several straps, shrink wrap and the like that the product is damaged during the bundling and transportation process. By using the counter rotation procedure, however, a mail sorting facility, whether it be a postal facility or other delivery or transportation facility, must reorient the stacks so that all of the bound edges are aligned. This allows for the sorting machines to properly sort and prepare for delivery of the product.

By way of example, in most modern postal facilities, major steps have been taken toward mechanization (e.g., automation) by the development of a number of machines and technologies. These machines and technologies include, amongst others, letter sorters, facer-cancelers, automatic address readers, parcel sorters, advanced tray conveyors, flat sorters, letter mail coding and stamp-tagging techniques and the like. As a result of these developments, postal facilities have become quite automated over the years, considerably reducing overhead costs.

In use, these machines and technologies such as flats sorting machines (FSM) are capable of processing more than 10,000 flats per hour by electronically identifying and separating prebarcoded mail, handwritten letters, and machine-imprinted pieces. Computer-driven single-line optical character readers (OCR) are used in this process.

However, many of the machines currently in use including, for example, the FSM require that the mail or flats be oriented in a certain manner in order for the machines to properly sort the mail for delivery. In order to accomplish this task for flats, human intervention is required to complete the product sorting process, i.e., rearrange stacks of flats received from the publisher to align the bound edges, to permit automated feeding of the product. This manual operation is both time consuming and costly, thus increasing overhead and hence delivery rates.

SUMMARY OF THE INVENTION

In a first aspect of the present invention, a flat mail sleeve packaging system is provided which is adapted to stack product in a constrained homogenous mass. In this aspect, a first constraining wall and a second constraining wall are provided. The second constraining wall is positioned with respect to the first constraining wall at a substantially perpendicular angle thereto. The first and second constraining walls are adapted for having the product placed therebetween with bound edges of the product all facing in a same direction without collapsing.

In embodiments of the first aspect, the system includes a first binding member extending between a length of one of the first and second constraining walls, and a second binding member, substantially perpendicular to the first binding member, used to provide additional stability to a stack of the product. The first and second constraining walls form a corner therebetween which is adapted to conform to a corner of the product, and a width of the first and second constraining walls is at least equal to or larger than a bound edge and the non bound edge of the product stacked thereon. The system may also include a third constraining wall which forms a "U" shape with the first and second constraining walls.

In a second aspect of the invention, a flat mail sleeve packaging system includes a first and second constraining wall, each having a length and a width. The second constraining wall is positioned with respect to the first constraining wall at a substantially perpendicular angle thereto to form a corner therebetween which is adapted to conform to a corner of the product. A binding member extends between the length of one of the first and second constraining walls. Each of the widths of the first and second constraining walls is at least equal to a bound edge and the non bound edge of the product stacked thereon, and the first and second constraining walls are adapted for having the product placed therebetween with bound edges of the product all facing in a same direction without collapsing.

In a third aspect of the invention, a method of stacking product in a same direction in a flat packaging sleeve system having at least a first constraining wall and a second constraining wall having a corner formed therebetween is provided. In this method, the user stacks the product with all bound edges facing a same direction towards either surface of the at least first constraining wall or second constraining wall. The user continues to stack the product with all bound edges facing a same direction until a length of the stacked product substantially equals a length of the at least first constraining wall and second constraining wall. A binding member is then placed about the stacked product in a lengthwise direction of one at least first constraining wall or the second constraining wall. In this manner, the product is in a straight constrained homogenous mass stack within the at least first constraining wall and second constraining wall. A second binding member, perpendicular to the binding member, may also be provided about the stacked product to provide additional stability.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to a flat mail sleeve packaging system and method of use. In this system, the flat mail sleeve packaging system allows a publisher or other user to stack bulk flats (also referred herein as product) in a non-counter rotated manner (i.e., a homogenous orientation) without having the stack of product collapse or become damaged during the stacking, binding or delivery process. This is accomplished by a system that includes a sleeve which is capable of holding the product in a straight constrained homogenous mass that can be easily handled and shipped without re-orientating the stack of product during the sorting process. In other swords, the product can be unbound and set on an automatic feeder at a postal delivery facility without any further processing. In this manner, manual operations need not be performed on the stacks prior to mail sorting.

Flat Mail Sleeve Packaging System of the Present Invention

Figure 1:
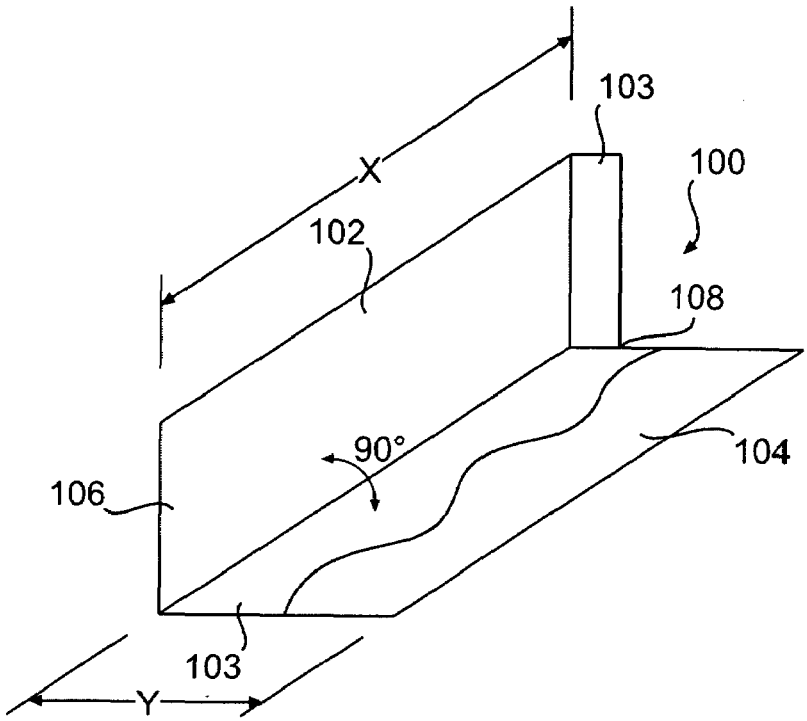
FIG. 1 is a schematic diagram of the flat mail sleeve packaging system of the present invention.

Referring now to FIG. 1, a schematic diagram of a first embodiment of the flat mail sleeve packaging system is shown. In this embodiment, the flat mail sleeve packaging system is depicted generally as reference numeral 100 and includes a first constraining wall 102 and a second constraining wall 104, both having constraining surfaces. In a preferred embodiment, the first constraining wall 102 includes a cut surface 106. In further embodiments, the first constraining wall 102 is at an angle with respect to the second constraining wall 104 thereby forming a corner 103 therebetween (conforming to a corner of the product placed thereon), and more specifically the first constraining wall 102 is at an angle of substantially 90° with respect to the second constraining wall 104 thereby forming an "L" shape. A first binding member 108 may also be used perpendicular to either the first constraining wall 102 or the second constraining wall 104. The first binding member 108 may be a strap, wrap, band, string or other similar binding member.

Still referring to FIG. 1, the length "X" of the first and second constraining walls 102,104 may vary depending on the particular use. For example, the length "X" of the first and second constraining walls 102,104 may be 24 inches long to thus allow for easy pallet stacking. However, this length is merely exemplary of the present invention and should not be considered a limiting factor. Similarly, the width "Y" may also vary, but should preferably be at least equal to or greater than the dimensions of the product stacked thereon. It is desirable, in embodiments, to fold any excess sleeve length to form endcaps 103 to protect end pieces of mail and to add rigidity to the system. The endcaps may be perpendicular to a length of the first or second constraining walls 102 and 104.

Figure 2:
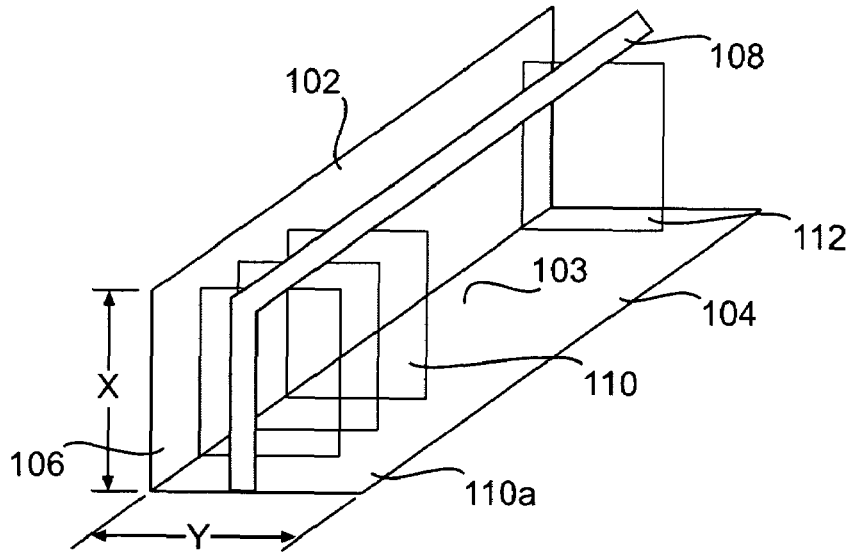
FIG. 2 shows the flat mail sleeve packaging system with flats or products stacked and bound thereon.

FIG. 2 shows the flat mail sleeve packaging system 100 with product 110 stacked and bound thereon. In this embodiment, the bound edges 110*a* of the product 110 are all oriented in a homogeneous arrangement facing the constraining wall 104; however, the bound edges 110*a* may equally be oriented facing the constraining wall 102. In either case, the binding member 108 is used to bind the product in a straight constrained homogenous mass. A second binding member 112, substantially perpendicular to the binding member 108, may also be used to provide additional stability to the stack of product. As further seen in FIG. 2, the width "Y" of both constraining walls 102 and 104 is larger than the bound and non bound edges of the product 110 stacked thereon. The second binding member 112 may be a strap, wrap, band, string or other similar binding member.

Figure 3:
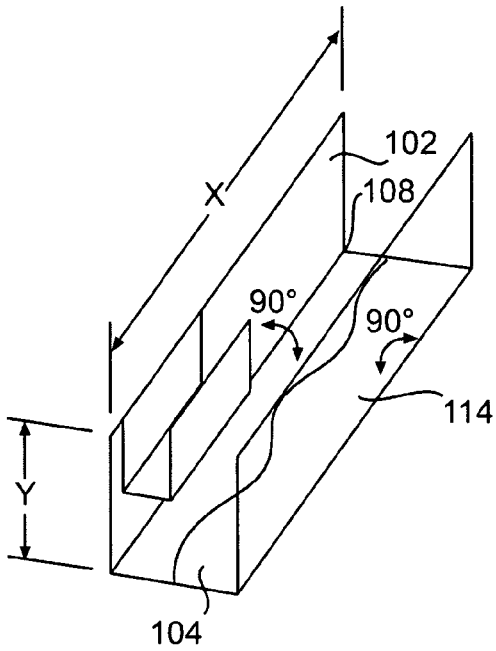
FIG. 3 shows a schematic diagram of an alternative flat mail sleeve packaging system of the present invention.

FIG. 3 shows an alternative embodiment of the flat mail sleeve packaging system 100 of the present invention. In this embodiment, a third constraining wall 114 facing the first constraining wall 102 is provided. The third constraining wall 114 is preferably substantially parallel to the first constraining wall 102 and perpendicular to the second constraining wall 104 thereby forming a "U" shape. In this configuration, the bound edges of the product may all be facing one of the first, second or third constraining wall 102, 104, 114 when being stacked on the flat mail sleeve packaging system 100 of the present invention. Also, in a preferred embodiment of this alternative embodiment, the first binding member 108 is attached across the length "X" of the central constraining wall 104.

In both the first and second embodiments of the present invention, the constraining walls may either be formed from a single piece of material bent at approximately right angles or, alternatively, may be made form separate segments attached together to form the first second and third constraining walls. In either case, the adjacent constraining walls of the first or second embodiment form corners 103 therebetween which are designed to constrain the product within the flat mail packaging sleeve of the present invention. Also, it is contemplated that both of the embodiments may include endcaps.

Figure 4:
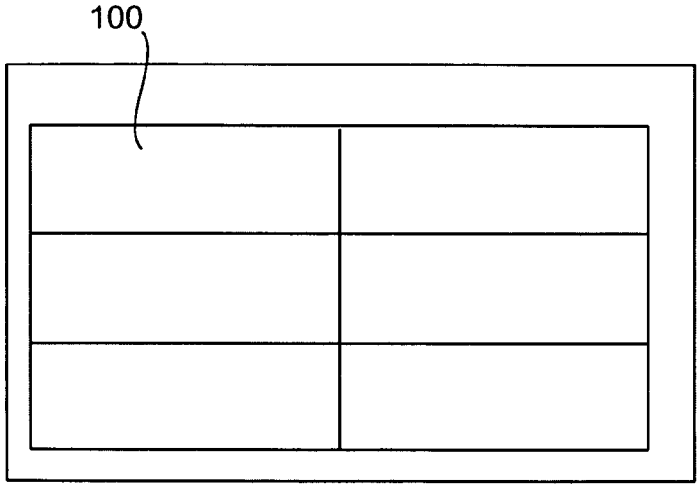
FIGS. 4 and 5 show views of the flat mail sleeve packaging system of the present invention on a pallet for shipping.
Figure 5:
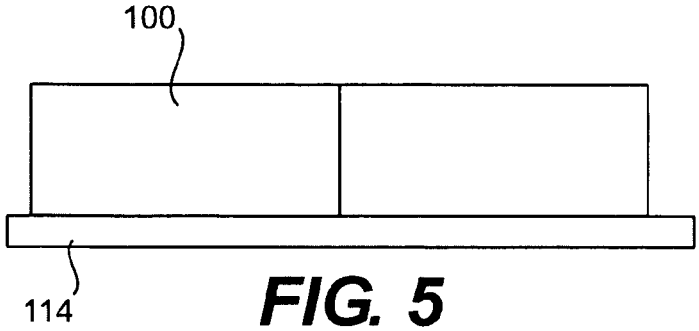
Figure 6:
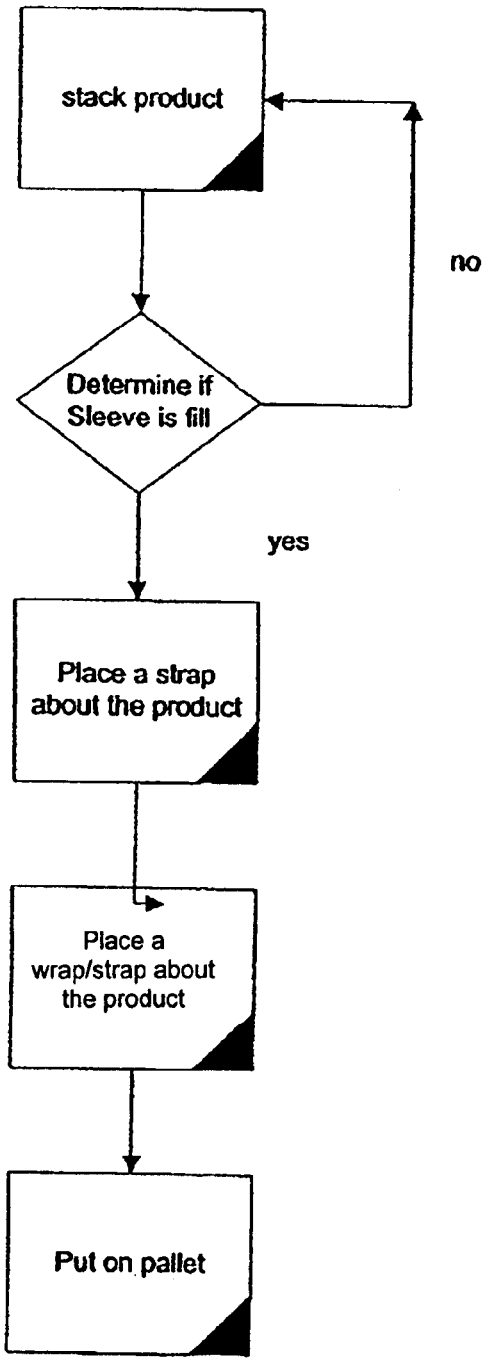
FIG. 6 is a flow diagram showing the steps of implementing the method of the present invention.

FIGS. 4 and 5 show the flat mail sleeve packaging system 100 of either the first or second embodiment positioned on a pallet 114. Specifically, FIG. 5 shows a top view of the pallet and FIG. 6 shows a side view of the pallet. In this scenario, six flat mail sleeve packaging systems 100 may be provided at each stacking level of the pallet. Because the product are constrained in each of the flat mail sleeve packaging systems 100, there is no possibility of the stacks of product collapsing.

Method of Using the Present Invention

FIG. 6 is a flow diagram showing the steps of implementing the method of the present invention. FIG. 6 may equally represent a high level block diagram of the system of the present invention, implementing the steps thereof.

In particular, in step 602, the publisher or user stacks the product with all of the bound edges facing a same direction towards any one of the surfaces of the present invention. In step 604, a determination is made as to whether the flat mail sleeve packaging system 100 of the present invention is completely filled with the product. If not, in step 602, the user continues to stack the product in a single homogenous orientation facing one surface of one of the constraining walls. Once the flat mail sleeve packaging system 100 is filled, in step 606, a binding member is placed about the stacked product in a lengthwise direction "X" of one of the constraining walls. This now constrains the stack of the product to provide a straight constrained homogenous mass. In step 608, a second binding member such as a wrap or strap may optionally be placed on the stack perpendicular to the first binding member. In step 610, the constrained stack is then stacked on a pallet. Steps 602 through 610 may be repeated until the pallet is filled or no more stacks are needed.

While the invention has been described in terms of preferred embodiments, those skilled in the art will recognize that the invention can be practiced with modification within the spirit and scope of the appended claims.

We claim:

1. An L-shaped flat mail sleeve packaging system made of a foldable material and having opposite facing ends and being adapted to stack product with bound and non bound edges in a constrained homogenous mass suitable for mailing, comprising:

a first constraining wall having a first constraining surface;

a second constraining wall having a second constraining surface, the second constraining wall being positioned with respect to the first constraining wall at a substantially perpendicular angle thereto so as to define the "L" shape of the L-shaped flat mail sleeve;

an end of the first constraining wall being folded over to form an end cap that is adapted to protect an end product of the stack and add rigidity to the flat mail sleeve packaging system;

the end cap extending only partially across a width of the second constraining wall so as to define a partially opened end of one of the opposite facing ends;

a first binding member extending from a first edge of the second constraining wall to the second edge of the second constraining wall for securing the stacked product with bound and non bound edges on the L-shaped flat mail sleeve;

wherein:

the first and second constraining walls are adapted for having the product placed therebetween with the bound and non bound edges of the product all facing in a same direction without collapsing, and when the product is placed in the L-shaped flat mail sleeve packaging system, two sides of the product are covered by the first and second constraining walls of the L-shaped flat mail sleeve packaging system while two other sides of the product remain uncovered by the L-shaped flat mail sleeve packaging system.

2. The flat mail sleeve packaging system of claim 1, wherein a width of the first and second constraining walls is at least equal to or greater than corresponding width dimensions of the stacked product.

3. The flat mail sleeve packaging system of claim 1, further comprising a second binding member, substantially perpendicular to the first binding member, used to provide additional stability to a stack of the product.

4. The flat mail sleeve packaging system of claim 1, wherein the first and second constraining walls form a corner therebetween which is adapted to conform to a corner of the product.

5. The flat mail sleeve packaging system of claim 1, wherein a width of the first and second constraining walls is adapted to be at last equal to the bound edges and the non bound edges of the product stacked thereon.

6. The flat mail sleeve packaging system of claim 1, further comprising another endcap extending from the other end of the first constraining wall.

7. The flat mail sleeve packaging system of claim 1, wherein the end cap has an overall length and a width which is greater than the overall length, whereby the overall length of the end cap is defined between a free end of the end cap and a corner formed by the end cap and the first constraining wall.

8. The flat mail sleeve packaging system of claim 1, wherein the width of the end cap is greater than a length of the end cap.

9. The flat mail sleeve packaging system of claim 1, wherein the width of the end cap corresponds to a width of the first constraining wall.

10. An L-shaped flat mail sleeve packaging system made of a foldable material and having opposite facing ends and being adapted to stack product with bound and non bound edges in a constrained homogenous mass suitable for mailing, comprising:

a first constraining wall having a first constraining surface, a length and a width a second constraining wall having a second constraining surface, a length and a width, the second constraining wall being positioned with respect to the first constraining wall at a substantially perpendicular angle thereto to form a corner therebetween which is adapted to conform to a corner of the product, and so as to define the "L" shape of the L-shaped flat mail sleeve;

a portion of the first constraining wall being folded over to form an end cap that is adapted to protect an end product of the stack and add rigidity to the flat mail sleeve packaging system;

the end cap having a width that corresponds to the width of the first constraining wall and a length extending only partially across a width of the second constraining wall so as to define a partially opened end of one of the opposite facing ends; and a first binding member traversing the length of the second constraining wall;

wherein:

each width of the first and second constraining walls is at last equal to the bound edges and the non bound edges of the product stacked thereon, and the first and second constraining walls are adapted for having the product placed therebetween with the bound edges of the product all facing in a same direction, and when the stacked product is placed in the L-shaped flat mail sleeve packaging system, two sides of the stacked product are covered by the first and second constraining walls of the L-shaped flat mail sleeve packaging system while two other sides of the stacked product remain uncovered by the L-shaped flat mail sleeve packaging system.

11. The flat mail sleeve packaging system of claim 10, further comprising a second binding member, substantially perpendicular to the first binding member, used to provide additional stability to a stack of the product.

12. The flat mail sleeve packaging system of claim 10, wherein the width of the first and second constraining walls is adapted to be larger than the bound edges and the non bound edges of the product stacked thereon.

13. The flat mail sleeve packaging system of claim 10, wherein the width of the end cap is greater than the length of the end cap.

14. An L-shaped flat mail sleeve packaging system made of a foldable material and having opposite facing ends and being adapted to stack product with bound and non bound edges in a constrained homogenous mass suitable for mailing, comprising:

an upper extending constraining wall having a first constraining surface and an overall length defined by corners of folded over first and second ends of the upper extending constraining wall;

a bottom constraining wall having a second constraining surface, the bottom constraining wall being positioned with respect to the upper extending constraining wall at a substantially perpendicular angle thereto so as to define the "L" shape of the L-shaped flat mail sleeve;

the folded over first and second ends of the upper extending constraining wall forming end caps that are adapted to protect end products of the stack and add rigidity to the flat mail sleeve packaging system;

one of the end caps extending only partially across a width of the second constraining wall so as to define a partially opened end of one of the opposite facing ends;

a first binding member extending along a length of the bottom constraining wall from one edge of the bottom constraining wall to another edge of the bottom constraining wall; and a second binding member, substantially perpendicular to the first binding member, used to provide additional stability to the stack of the product;

wherein:

the upper extending and bottom constraining walls are adapted for having the product placed therebetween with the bound edges and non bound edges of the product all facing in a same direction without collapsing, and when the stacked product is placed in the L-shaped flat mail sleeve packaging system, two sides of the stacked product are covered by the first and second constraining walls of the L-shaped flat mail sleeve packaging system while two other sides of the stacked product remain uncovered by the L-shaped flat mail sleeve packaging system.

15. The flat mail sleeve packaging system of claim 14, wherein the overall length is greater than a width of the upper extending constraining wall.

* * * * *